US007098175B2

(12) United States Patent
Hsu et al.

(10) Patent No.: US 7,098,175 B2
(45) Date of Patent: Aug. 29, 2006

(54) AQUEOUS DETERGENT COMPOSITION CONTAINING ETHOXYLATED FATTY ACID DI-ESTER

(75) Inventors: Feng-Lung Gordon Hsu, Tenafly, NJ (US); Shui-Ping Zhu, New Milford, NJ (US); Yun-Peng Zhu, Fairlawn, NJ (US)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 21 days.

(21) Appl. No.: 10/863,119

(22) Filed: Jun. 8, 2004

(65) Prior Publication Data

US 2005/0272627 A1 Dec. 8, 2005

(51) Int. Cl.

| | |
|---|---|
| ***C11D 1/66*** | (2006.01) |
| ***C11D 1/78*** | (2006.01) |
| ***C11D 3/20*** | (2006.01) |
| ***C11D 3/43*** | (2006.01) |

(52) U.S. Cl. ..... 510/353; 510/328; 510/337; 510/356; 510/360; 510/421; 510/437; 510/475

(58) Field of Classification Search ..... 510/328, 510/337, 353, 356, 360, 421, 437, 475
See application file for complete search history.

(56) References Cited

U.S. PATENT DOCUMENTS

| | | | | |
|---|---|---|---|---|
| 3,231,505 | A | 1/1966 | Farrar et al. | 252/138 |
| 3,232,506 | A | 2/1966 | Rabinow | 225/93 |
| 3,884,946 | A | 5/1975 | Sung et al. | 260/400 |
| 4,343,726 | A | 8/1982 | Egan et al. | 252/547 |
| 5,279,313 | A | 1/1994 | Clausen et al. | 132/208 |
| 5,382,375 | A | 1/1995 | You et al. | 252/117 |
| 5,854,201 | A | 12/1998 | Behler et al. | 510/515 |
| 6,107,268 | A | 8/2000 | Yahiaoui et al. | 510/438 |
| 6,300,508 | B1 | 10/2001 | Raths et al. | 554/149 |
| 2002/0042352 | A1 | 4/2002 | Yahiaoui et al. | 510/175 |

FOREIGN PATENT DOCUMENTS

| | | |
|---|---|---|
| DE | 195 02 454 | 8/1996 |
| EP | 913 458 | 5/1999 |
| EP | 1092761 A2 * | 4/2001 |
| EP | 10 92 761 | 2/2004 |
| GB | 1 465 700 | 2/1977 |
| GB | 1 546 829 | 5/1979 |
| GB | 2 141 965 | 1/1985 |
| JP | 50 119812 | 9/1975 |
| WO | 96/23049 | 8/1996 |
| WO | 96/29389 | 9/1996 |
| WO | 00/31221 | 6/2000 |

OTHER PUBLICATIONS

"*Group Selectivity of Ethoxylation of Hydroxy Acids*", by A.J. O'Lenick, Jr., www.zenitech.com/documents/castor-oul.pdf.
Journal of Surfactants and Detergent, "Synthesis and Chemical Hydrolysis of Surface-Active Esters", M. Stjerndahl and K. Holmberg, vol. 6, No. 4 (Oct., 2003), pp. 311-318.
PCT International Search Report in a PCT application PCT/EP2005/005753.
Derwent Abstract of DE 195 02 454—published Aug. 1, 1996.
Derwent Abstract of JP 50 119812—published Sep. 19, 1975.

* cited by examiner

*Primary Examiner*—Brian P. Mruk
(74) *Attorney, Agent, or Firm*—Rimma Mitelman

(57) ABSTRACT

Aqueous laundry detergent compositions comprising a solubilized ethoxylated fatty acid diester as a detergency booster and/or a defoamer. Preferred compositions include a nonionic surfactant, preferably ethoxylated fatty acid monoester, as at least part of the surfactant in the composition, and also functioning as the solibilizer for the ethoxylated fatty acid diester.

5 Claims, No Drawings

AQUEOUS DETERGENT COMPOSITION CONTAINING ETHOXYLATED FATTY ACID DI-ESTER

FIELD OF THE INVENTION

The present invention relates to aqueous isotropic laundry detergent compositions comprising an ethoxylated fatty acid diester as a detergency booster and/or a defoamer.

BACKGROUND OF THE INVENTION

Liquid laundry detergents are popular with the consumers. Despite numerous liquid detergent products on the market, however, a continuous consumer need exists for lower cost without compromising the performance of the detergent, or even providing improved performance at the same cost.

Ethoxylated fatty acid di-esters (hereinafter "EFADs") may be co-produced with ethoxylated fatty acid mono-ester, as shown in "Group Selectivity of Ethoxylation of Hydroxy Acids" by A. J. O'lenick, Jr., www.zenitech.com/documents/castor-oul.pdf. M. Stjerndahl et. al. disclosed a method of preparing high purity of ethoxylated fatty acid via esterification with excess of Polyethylene glycol in "Synthesis and Chemical Hydrolysis of Surface-Active Esters", *J. of Surfactants and Detergents*, Vol 6, No. 4 (October, 2003) pages 311–318. The same method may be used for making high purity of di-ester with excess of fatty acid chloride. U.S. Pat. Nos. 3,884,946 6,300,508 B1 disclose the products of ethoxylated fatty acid including 2.3% or less of di-ester as a by-product. There are patents, such as US 2002/0042352 A1, U.S. Pat. No. 3,232,506, U.S. Pat. No. 6,107,268, U.S. Pat. No. 3,231,505, U.S. Pat. No. 5,279,313, U.S. Pat. No. 5,854,201, WO 96/29389, WO 96/23049, WO 00/31221, and GB 2,141,965A, disclosed of using ethoxylated fatty acid mono-ester for various applications.

EFADs are not generally regarded as detergent surfactants, due to their relatively low HLB values. Furthermore, EFADs have low to none water-solubility. See for instance EP1092761, which discloses the use of EFADS to generate pearly luster—which means that the EFAD is not solubilised. Thus, the laundry detergent art does not provide any motivation and/or expectation of success for inclusion of EFADs into aqueous, isotropic laundry detergent compositions.

The present invention is based at least in part on the discovery that the inclusion of relatively small quantities of EFADs into aqueous laundry detergent compositions boosts the detergent surfactant performance. By virtue of the surprising boosting effect of EFADs the surfactant amount in the formulation can be decreased (resulting in lower cost of manufacture), while maintaining soil removal performance of the detergent, or even improving it on some types of soil. Furthermore, EFADs provide economical de-foaming benefits without adverse effects, such as haziness, caused by a silicone defomer.

SUMMARY OF THE INVENTION

The present invention includes an aqueous isotropic liquid laundry detergent composition comprising:

(a) from about 0.1% to about 10%, by weight of the composition of an ethoxylated fatty acid diester;

(b) from about 5% to about 85%, by weight of the composition, of a detergent surfactant comprising at least about 2%, by weight of the composition, of water-soluble surfactant;

(c) from about 15% to about 95% of water.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the aqueous liquid detergent omposition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

"Isotropic" as used herein means a single phase when viewed macroscopically (without the aid of instruments, other than eyeglasses) at 20° C. The surfactants and the diester in an isotropic solution are aggregated into micelle structure, which is also known as $L_1$ phase. By contrast, if the ethoxylated fatty aciddiester is not solubilized (as in the prior art) then at least part of it is present as a particulate form, and not as part of the micelle.

Ethoxylated Fatty Acid Di-Esters ("EFADS")

EFADs used in this inventive detergent composition are selected from one or more EFADs which have a chemical structure as follows:

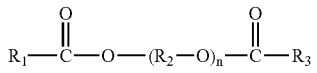

Where $R_1$ and $R_3$ are selected from linear or branched $C_6$ to $C_{20}$ cyclic or non-cyclic alkyl or alkylene groups, and cyclic or non-cyclic aliphatic group, $R_2$ are selected from $C_2H_4$ or $C_3H_6$ groups;

and n has a value between 1 to 20, preferably from 3 to 15.

The amount of EFADs employed in the inventive compositions is in the range of from 0.1% to 10%, preferably from 0.5% to 7%, most preferably from 1.0% to 5%.

Surfactant

The compositions of the invention contain surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

By virtue of employing the EFAD booster according to the present invention, the total surfactant level may be reduced while maintaining or, in case of some types of soils, even improving performance.

Thus, the total level of surfactant in the present compositions is from 5% to 85%, preferably from 10% to 50%, and most preferably in order to maintain performance at lower cost, from 12% to 25%.

According to the present invention, the surfactant comprises at least 2%, by weight of the composition, of a water-soluble surfactant, which also serves as the solubiliser for EFADs. The preferred water-soluble surfactant is nonionic surfactant, because it is liquid at room temperature. The nonionic surfactant is especially preferred for low-foaming compositions of the invention. The nonionic surfactant is present preferably in an amount of at least 4% and most preferably from 6 to 80% by weight of the composition.

The minimum ratio of the water-soluble surfactant to EFAD, by weight percentage, is generally in the range from 1:4 to 100:1, preferably in the range from 1:2 to 50:1, and most preferably in the range from 1:1 to 10:1.

According to the preferred embodiment of the invention, the nonionic surfactant comprises at least 0.1%, preferably from 0.5 to 10% by weight of the composition, of an ethoxylated fatty acid monoester, since the EFAD may be co-produced with the ethoxylated fatty acid monoester by manipulation of the processing condition. Furthermore, EFAD may be solubilized in ethoxylated fatty acid monoester as a liquid ingredient for ease of handling.

Nonionic Surfactant

Nonionic surfactants which can be used with the invention, alone or in combination with other surfactants are described below. As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23–6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$, fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Another preferred class of nonionic detergent is the alkoxylated fatty acid monoester wherein the fatty acid is of 8 to 20 carbon atoms and wherein the number of moles of alkylene oxide (of 2 or 3 carbon atoms) is from 3 to 20.

Another suitable monoester is an alkoxylated alkyl fatty acid alkyl monoester, wherein the fatty acid is of 8 to 20 carbon atoms, alkyl monoester is of 2 to 3 carbon atoms and wherein the number of moles of alkylene oxide (of 2 or 3 carbon atoms) is from 3 to 20.

Another class of nonionic surfactants which can be used in accordance with this invention are glycoside surfactants. Glycoside surfactants suitable for use in accordance with the present invention include those of the formula:

$$RO—R^2O_y\text{-}(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0–75% by wt., preferably 3 to 50%, more preferably 5 to 25% by wt. of the composition. Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophile group, i.e. water solubilizing group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl sulfonates, alkyl sulfonates, alkyl sulfates and the alkyl poly ether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine sulfate can be used in admixture with the alkylbenzene sulfonate in an amount of 0 to 70%, preferably 5 to 50% by weight.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-l-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine. Sodium 3-(dodecylamino) propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

As noted the preferred surfactant systems of the invention are mixtures of anionic and nonionic surfactants.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 2:1.

Water

The inventive compositions are aqueous—that is, the inventive compositions comprise generally from 20% to 99.9% preferably from 40% to 80%, most preferably, to achieve optimum cost and ease of manufacturing, from 50% to 70% of water. Other liquid components, such as co-solvents, surfactants, liquid organic matters including organic bases, and their mixtures can be co-present with water.

Co-solvents that may be present include but are not limited to alcohols, surfactant, fatty alcohol ethoxylated sulfate or surfactant mixes), alkanol amine, polyamine, other polar or non-polar solvents, and mixtures thereof.

Optional Ingredients

Solubiliser

EFADs are not soluble or not entirely soluble in water. In the inventive compositions EFADS are present in a solubilised form. Hence, the inventive aqueous-based, isotropic compositions include a solubiliser for EFADs, which is a water-soluble surfactant (such as polyethoxy sulfate, linear alkylsulfonate, soap, and amine oxide), preferably the nonionic surfactant (described above). An additional solubiliser may be present, to improve the clarity of the compositions. An additional solubiliser is selected from the group consisting of solvents (such as polyols, polyethylene glycol, ethylene glycol, propylene glycol, glycerin, ethanol, propanol and short-chain alkyl polyethylene glycols), and/or hydrotrotropes (such as xylenesulfonate), and the mixture of them.

The additional solubiliser is typically present in an amount of from 1 to 85%, preferably from 4 to 50%, most preferably from 5 to 35%.

Fluorescent Whitening Agent

The inventive compositions preferably include from 0.01% to 2.0%, more preferably from 0.05% to 1.0%, most preferably from 0.05% to 0.5% of a fluorescer. Examples of suitable fluorescers include but are not limited to derivatives of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $Na_x(_y.AlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may be used in the compositions of the invention.

If a lipase is used, the lipolytic enzyme may be either a fungal lipase producible by Humicola lanuginosa and Thermomyces lanuginosus, or a bacterial lipase which show a positive immunological cross-reaction with the antibody of the lipase produced by the microorganism Chromobacter viscosum var. lipolyticum NRRL B-3673.

An example of a fungal lipase as defined above is the lipase ex Humicola lanuginosa, available from Amano under the tradename Amano CE; the lipase ex Humicola lanuginosa as described in the aforesaid European Patent Application 0,258,068 (NOVO), as well as the lipase obtained by cloning the gene from Humicola lanuginosa and expressing this gene in Aspergillus oryzae, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected sos that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable.

Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application. A pH jump heavy duty liquid is a composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guam.

In addition, various other detergent additives or adjuvants may be present in the detergent product to give it additional desired properties, either of functional or aesthetic nature.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added in small effective amounts, although it should be noted that the inventive compositions are low-foaming.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Process of Making

The inventive compositions may be prepared by any method known to one of ordinary skill in the art.

The preferred process is as follows:

Premix 1 was prepared by mixing nonionic surfactant and EFAD at 50° C. to form a clear liquid. Alternatively, fatty acid and LAS acid may be formed Premix 2 by mixing about 1 part of fatty acid with about 5 parts of LAS acid and heated to 60° C. to form a clear liquid, followed by the addition of the rest of LAS acid without heat. Water, Na-Xylene-sulfonate and/or other hydrotropes, 50% NaOH solution and borax were added to the main mix to form a clear solution. Followed by the addition of conjugated acids of anionic surfactants or Premix 2. After the neutralization, Premix 1 was added and mixed into the main mix. The rest of the ingredients, such as sodium LES, whitening agent, functional polymers, perfume, enzyme, colorant, preservatives were added at the last stage and mixed until the batch became an isotropic liquid.

Preferably, the detergent composition is a colored composition packaged in the transparent/translucent ("see-through") container.

Container

Preferred containers are transparent/translucent bottles. "Transparent" as used herein includes both transparent and translucent and means that a composition, or a package according to the invention preferably has a transmittance of more than 25%. more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic co-polymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of using Compositions

In use, the indicated quantity of the composition (generally in the range from 50 to 200 ml) depending on the size of the laundry load, the size and type of the washing machine, is added to the washing machine which also contains water and the soiled laundry. The inventive compositions are particularly suited for use with front-loading washing machine, due to the ability of the inventive compositions to deliver high performance with low foaming—front-loading machines require low foaming compositions.

The following specific examples further illustrate the invention, but the invention is not limited thereto.

The following abbreviations and/or tradenames were used in the Examples:

LAS acid: Linear Alkylbenzene Sulfonic Acid

Na-LAS: Sodium Alkylbenzene Sulfonate

Neodol 25-9: 9 EO Ethoxylated $C_{12-15}$ Fatty Alcohol

Na-LES: Sodium Linear Alcohol Ethoxylate Sulfate

Particulate Soil Removal Evaluation:

Evaluation for removal of particulate soil was conducted from a single wash in warm water at 32° C. A benchmark detergent was also tested for the purpose of comparison. The fabrics used in the test were cotton and 50/50cotton/polyester. A Hunter reflection meter was used to measure L, a, and b which are taken to calculate SRI Index values using the following equation: $SRI=100-[(Lf-Li)^2+(af-ai)^2+(bf-bi)^2]^{1/2}$. The delta value is the difference between the prototype sample and the benchmark in SRI Index. Statistical significance of the data was calculated at 95% confidence level using SAS/JMP Analysis of variance. The higher the SRI value, the better the cleaning.

Foam Height Test

The foam height test was measured by the method of "The Standard Test Method for Foaming Properties of Surface Active Agents" as described in ASTM D1173-53 method. Formulations at a concentration of 0.19% were used. Initial foam height and the foam heights up to 5 minutes were recorded every minute.

COMPARATIVE EXAMPLE A AND EXAMPLE 1

Example 1 (within the scope of the present invention) demonstrated the booster effect of the addition of EFAD relative to Comparative Example A (outside the scope of the invention). The Examples were prepared by the following procedure. Premix 1 was prepared by mixing 1 part of stearic acid with 5 parts of LAS acid and heated to 60° C. to form a clear liquid, followed by the addition of the rest of LAS acid without heat. For Example 1, Premix 2 was prepared by mixing Neodol 25-9 and di-ester at 50° C. to form a clear liquid. Subsequently, water, Na-Xylenesulfonate, 50% NaOH solution and borax were added to the main mix to form a clear solution. Premix 1 was added and mixed into the main mix until the full neutralization. The rest of the ingredients were added at the last stage and mixed until the batch became an isotropic liquid. The final pH values of the batches were about 9.2. Soil removal of various soils was evaluated. The results that were obtained are summarised in Table 1.

TABLE 1

| | Examples | |
|---|---|---|
| ingredients | A % | 1 % |
| Borax | 1.50 | 1.50 |
| Na-Xylenesulfonate | 0.50 | 0.50 |
| Na-LAS | 10.22 | 10.22 |
| Na stearate | 0.43 | 0.43 |
| Neodol 25-9 | 9.53 | 7.62 |
| 9EO distearate | | 1.91 |
| Misc | 0.1 | 0.1 |
| Water | To 100 | To 100 |
| EFAD | 0.00 | 1.91 |
| surfactants | 20.18 | 18.27 |
| EFAD + surfactants | 20.18 | 20.18 |
| Detergency on cotton - SRI | | |
| beef dripping | 93.32 | 93.93 |
| ice cream | 91.37 | 91.74 |
| grape | 87.89 | 89.23 |
| mud | 79.56 | 79.36 |
| spaghetti sauce | 83.93 | 85.95 |

TABLE 1-continued

| Detergency on 50/50 polyester/cotton blend - SRI | | |
|---|---|---|
| beef dripping | 94.10 | 94.74 |
| ice cream | 94.91 | 95.33 |
| grape | 91.34 | 92.14 |
| mud | 82.87 | 82.43 |
| spaghetti sauce | 82.10 | 81.24 |
| Time; Minutes | Foam Height; cm | |
| 0 | 8.0 | 4.5 |
| 1 | 4.5 | 1.0 |
| 2 | 4.0 | 0.8 |
| 3 | 3.0 | 0.7 |
| 4 | 2.8 | 0.6 |
| 5 | 2.7 | 0.5 |

There was 9.5% reduction of total detergent actives (surfactants) in Example 1, compared to Example A. As can be seen from the results in Table 1, surprisingly, the replacement of 9.5% of a detergent surfactant with a non-detergent active, EFAD, did not reduce the detergency but improved the overall performance (i.e. improved the cleaning of several types of stains). The foam reduction benefit of using EFAD is also evident from the results in Table 4.

EXAMPLES 2–3 AND COMPARATIVE EXAMPLE B

The Examples in Table 2 were prepared by following the procedure described for Example 1, except the Neodol 25-9 was replaced with 9-EO monooleate. The results that were obtained are summarised in Table 2.

TABLE 2

| | Examples | | |
|---|---|---|---|
| ingredients | B % | 2 % | 3 % |
| Borax | 1.50 | 1.50 | 1.50 |
| Na xylenesulfonate | 0.50 | 0.50 | 0.50 |
| Na-LAS | 10.22 | 10.22 | 10.22 |
| Na stearate | 0.43 | 0.43 | 0.43 |
| 9EO monooleate | 9.53 | 7.62 | 4.77 |
| 9EO distearate | | 1.91 | 4.77 |
| Miscellaneous | 0.1 | 0.1 | 0.1 |
| Water | To 100 | To 100 | To 100 |
| EFAD | 0.00 | 1.91 | 4.77 |
| surfactants | 20.18 | 18.27 | 15.42 |
| EFAD + surfactants | 20.18 | 20.18 | 20.18 |
| Detergency on cotton - SRI | | | |
| beef dripping | 93.37 | 93.71 | 92.97 |
| ice cream | 91.64 | 92.08 | 91.64 |
| mud | 79.53 | 79.22 | 79.37 |
| spaghetti sauce | 84.96 | 85.38 | 84.61 |
| Detergency on 50/50 polyester/cotton blend - SRI | | | |
| beef dripping | 94.17 | 94.15 | 93.88 |
| ice cream | 95.08 | 93.66 | 94.69 |
| mud | 82.35 | 82.65 | 82.17 |
| spaghetti sauce | 80.80 | 81.70 | 82.10 |

Examples 2 and 3, both within the scope of the present have reduced level of total surfactant by 9.5% and 24%, respectively, relative to the Comparative Example B. Again, the addition of the non-detergent active EFAD maintain the same detergency, or even improves performance with some types of stains, at lower surfactant levels.

EXAMPLES 4–5 AND COMPARATIVE EXAMPLE C

Examples 4 and 5 were prepared by making Premix 1 by mixing and heating EFAD with either Neodol 25-9 or mono-ester of ethoxylated fatty acid to form an isotropic liquid. The order of addition in the Main-mix for all three examples was water, Na-Citrate, Triethanolamine, Di-ethanolamine, and borax. After the full dissolution of borax, Na-Xylenesulfonate, LAS acid and fatty acid were added into the batch, followed by the rest of the ingredients, including Premix 1, to the batch and mixed until the batch reached the isotropic stage. The pH values of the examples were about 7.8. The results that were obtained are summarised in Table 3.

TABLE 3

| | Examples | | |
|---|---|---|---|
| ingredients | C % | 4 % | 5 % |
| Borax | 3.00 | 3.00 | 3.00 |
| Na citrate | 2.63 | 2.63 | 2.63 |
| Triethanolamine | 1.00 | 1.00 | 1.00 |
| Na-LAS | 4.50 | 4.50 | 4.50 |
| MEA | 0.30 | 0.30 | 0.30 |
| Coco Fatty Acid | 1.00 | 1.00 | 1.00 |
| Na-LES | 8.36 | 8.36 | 8.36 |
| Neodol 25-9 | 9.30 | | 7.44 |
| 9EO monococonate | | 3.72 | |
| 9EO dicoconate | | 3.72 | |
| 9EO dilaurate | | | 1.86 |
| Propylene glycol | 1.4 | 1.4 | 1.4 |
| Miscellaneous | 1.62 | 3.49 | 1.63 |
| Water | To 100 | To 100 | To 100 |
| EFAD | 0.00 | 3.72 | 1.86 |
| surfactants | 23.46 | 17.88 | 21.60 |
| EFAD + surfactants | 23.46 | 21.60 | 23.46 |
| Detergency on cotton - SRI | | | |
| beef dripping | 99.66 | 99.11 | 99.20 |
| ice cream | 92.67 | 92.87 | 92.47 |
| grape | 87.93 | 87.81 | 87.78 |
| mud | 80.65 | 81.03 | 81.19 |
| spaghetti sauce | 88.02 | 86.16 | 89.27 |
| AS10* | 18.42 | 19.45 | 18.39 |
| Detergency on 50/50 polyester/cotton blend - SRI | | | |
| beef dripping | 96.43 | 95.95 | 95.77 |
| ice cream | 95.02 | 94.93 | 95.01 |
| grape | 89.94 | 89.92 | 90.12 |
| mud | 83.28 | 83.10 | 82.78 |
| spaghetti sauce | 85.83 | 84.47 | 86.37 |

*AS10 is a protein & oily/particulate on cotton stain cloth swatch.

Examples 4 and 5, both within the scope of the present have reduced levels of surfactant by 24% and 8%, respectively, relative to the Comparative Example C. Again, the addition of the non-detergent active EFAD maintains the same detergency, or even improves performance with some types of stains, at lower surfactant levels.

EXAMPLES 6–8 AND COMPARATIVE EXAMPLE D

Examples 6–8 and comparative example D were prepared following the similar procedure described in Example 1 and Comparative example A.

TABLE 4

| | Examples | | | |
|---|---|---|---|---|
| ingredient | D % | 6 % | 7 % | 8 % |
| water | 75.70 | 75.70 | 75.70 | 75.70 |
| Na OH 50% | 2.67 | 2.67 | 2.67 | 2.67 |
| borax | 1.00 | 1.00 | 1.00 | 1.00 |
| sodium sulfate | 1.00 | 1.00 | 1.00 | 1.00 |
| LAS acid | 10.00 | 10.00 | 10.00 | 10.00 |
| Na-LES | 9.53 | 9.53 | 9.53 | 9.53 |
| 9 EO distearate | 0.00 | 2.00 | 4.00 | 8.00 |
| Misc. | 0.5 | 0.5 | 0.5 | 0.5 |
| water | To 100 | To 100 | To 100 | To 100 |
| FOAM HEIGHT IN CENTIMETERS | | | | |
| Time (minute) | cm | cm | cm | cm |
| 0 | 15.50 | 12.80 | 12.50 | 11.80 |
| 1 | 14.00 | 9.00 | 8.50 | 6.50 |
| 2 | 14.00 | 6.20 | 4.00 | 2.50 |
| 3 | 13.70 | 3.90 | 1.50 | 1.60 |
| 4 | 13.60 | 2.00 | 1.00 | 1.30 |
| 5 | 13.60 | 1.90 | 0.90 | 0.80 |

Table 4 clearly demonstrates the antifoam effect of EFAD.

What is claimed is:

1. An aqueous isotropic liquid laundry detergent composition comprising:

(a) from about 0.1% to about 10%, by weight of the composition of a solubilized ethoxylated fatty acid diester;

(b) from about 5% to about 85%, by weight of the composition, of a detergent surfactant comprising at least about 2%, by weight of the composition, of a water-soluble nonionic surfactant comprising an alkoxylated alkyl monoester surfactant, wherein the weight ratio of the ethoxylated fatty acid diester to the water-soluble surfactant is in the ratio from about 4:1 to about 1:100;

(c) from about 15% to about 95% of water.

2. The composition of claim 1, wherein the detergent surfactant amount is from about 10% to about 50%, by weight of the composition.

3. The composition of claim 1 wherein the foam height of the composition after 3 minutes of the test according to ASTM D1173-53 method is less than 5 cm.

4. The composition of claim 1, wherein the nonionic surfactant comprises at least about 0.1%, by weight of the composition of the alkoxylated alkyl monoester.

5. The composition of claim 1 wherein the composition further comprises from about 0.1 to about 25% of an additional solubilizer for the ethoxylated fatty acid diester, selected from the group consisting of polyols, polyethylene glycol, ethylene glycol, propylene glycol, glycerin, ethanol, propanol and short-chain alkyl polyethylene glycols, hydrotropes, and mixtures thereof.

* * * * *